US007467531B2

(12) United States Patent
Lai et al.

(10) Patent No.: US 7,467,531 B2
(45) Date of Patent: Dec. 23, 2008

(54) KEY OPERATED PADLOCK CONSTRUCTION WITH VISUAL INDICATOR

(75) Inventors: Eric Lai, Hong Kong (HK); Karl Lai, Hong Kong (HK)

(73) Assignee: The Sun Lock Company Ltd., Tuen Mun, N.T. (HK)

( * ) Notice: Subject to any disclaimer, the term of this patent is extended or adjusted under 35 U.S.C. 154(b) by 101 days.

(21) Appl. No.: 11/405,332

(22) Filed: Apr. 17, 2006

(65) Prior Publication Data

US 2006/0260369 A1 Nov. 23, 2006

Related U.S. Application Data

(60) Provisional application No. 60/683,208, filed on May 20, 2005.

(51) Int. Cl.
*E05B 67/22* (2006.01)
*E05B 41/00* (2006.01)

(52) U.S. Cl. ..... 70/38 C; 70/35; 70/337; 70/432; 70/441

(58) Field of Classification Search ..... 70/35, 70/38 B, 38 C, 38 R, 53, 337, 339, 340, 432, 70/435, 437, 441, 21, 25–30, 284, 285
See application file for complete search history.

(56) References Cited

U.S. PATENT DOCUMENTS

| | | | | |
|---|---|---|---|---|
| 1,757,020 | A | 5/1930 | Ramey | |
| 2,048,570 | A * | 7/1936 | Slaymaker | 70/38 C |
| 2,048,571 | A * | 7/1936 | Slaymaker | 70/38 C |
| 2,163,311 | A * | 6/1939 | Raymond | 70/38 C |
| 2,834,195 | A * | 5/1958 | Stackhouse | 70/339 |
| 3,221,526 | A | 12/1965 | Stackhouse | |
| 3,824,819 | A * | 7/1974 | Neary | 70/432 |
| 6,047,577 | A | 4/2000 | Klimas | |
| 6,516,643 | B1 | 2/2003 | Olshausen | |
| 6,860,131 | B2 * | 3/2005 | Armstrong et al. | 70/492 |
| 6,877,345 | B1 | 4/2005 | Misner et al. | |
| 7,216,517 | B2 * | 5/2007 | Ling et al. | 70/21 |

* cited by examiner

*Primary Examiner*—Patricia L Engle
*Assistant Examiner*—Christopher Boswell
(74) *Attorney, Agent, or Firm*—Melvin I. Stoltz

(57) ABSTRACT

By providing an automatically activated positive indicator or signal which is responsive to only the use of a master key, a padlock construction is achieved which is highly effective for providing notice to the user whenever the padlock has been opened by said master key. In accordance with the present invention, the positive indicator or signal is constructed for being automatically activated whenever the master key is employed, with said indicator or signal being locked in its activated position, and capable of being re-set by only the user.

18 Claims, 11 Drawing Sheets

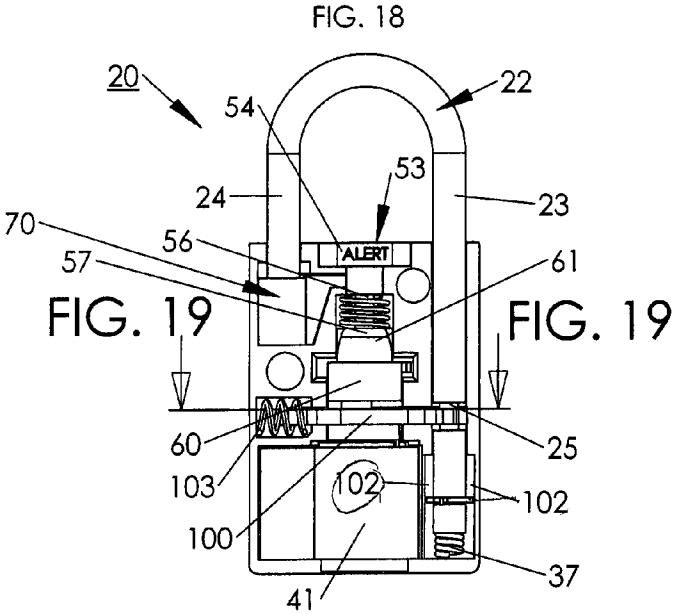
FIG. 18
FIG. 19
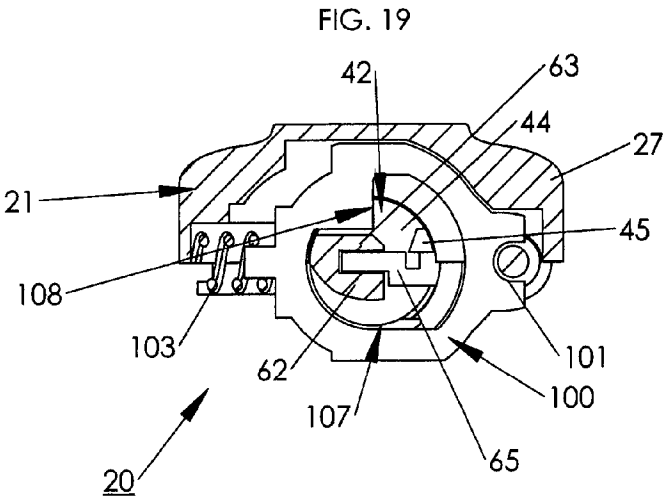
FIG. 19
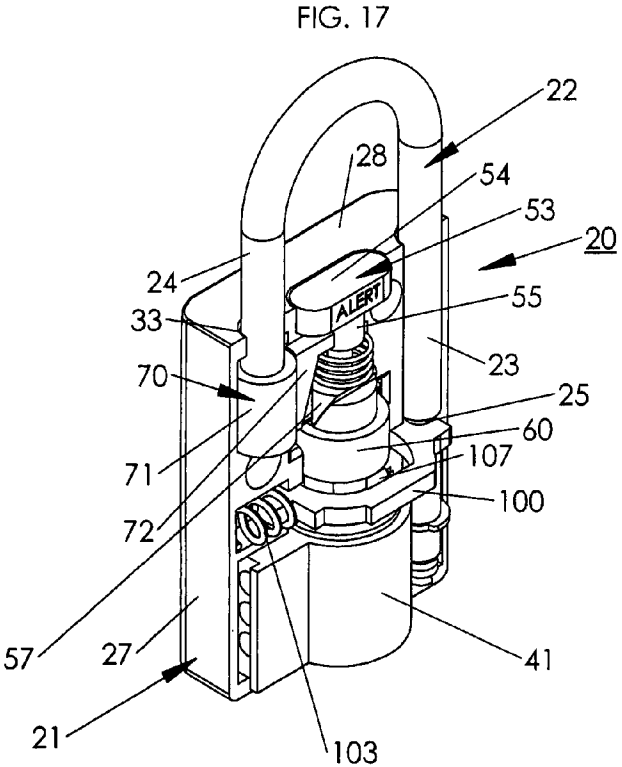
FIG. 17

KEY OPERATED PADLOCK CONSTRUCTION WITH VISUAL INDICATOR

RELATED APPLICATIONS

This application is related to U.S. Provisional Patent Application Ser. No. 60/683,208, filed May 20, 2005 entitled KEY OPERATED PADLOCK CONSTRUCTION WITH VISUAL INDICATOR.

TECHNICAL FIELD

This invention relates to padlocks and lock systems and, more particularly, to padlocks constructed to provide a positive alert indication under specific, desired circumstances.

BACKGROUND ART

Numerous padlock constructions have been developed and are widely employed by individuals to prevent unauthorized persons from gaining access to any particular item or area which has been closed and locked. In this regard, many lock constructions are designed to be opened by a key, while numerous combination lock constructions have also been developed which are open by knowledge of a particular combination.

One particular type of combination lock that has become very popular due to its convenience of use is a combination lock which employs a plurality of rotatable independent dials, each of which forms one of the indicia, usually numerals or letters, which comprise a combination for releasing the lock. Typically, the combination lock has one mode or position in which the user is able to set or reset the desired combination sequence. However, in spite of the popularity of these combination locks, key-operated locks remain the most popular and most prevalent.

In spite of the substantial effort which has been expended in developing key control padlocks, prior art constructions continue to suffer from the use of components which are difficult and expensive to manufacture. In particular, one of the principal components of key controlled padlocks is the rotatable cylinder plug which is rotationally mounted in a cylinder housing and is constructed for being responsive to a particularly key for enabling the cylinder plug to rotate about its central axis.

Although the cylinder plug is a principal element and is required in each key controlled padlock construction, cylinder plugs are expensive to manufacture since they must be individually cut from round metal rods and then individually machined to obtain the desired construction. As a result, substantial effort and expense is required. Furthermore, although this problem has existed in the art for numerous years, no effective resolution of this difficulty has been realized.

Another common problem which has consistently plagued prior art constructions is the assembly and production costs associated with key controlled padlocks. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal components of the lock, thereby causing damage to these components or interfering with the ease of operation of the lock. Although numerous attempts have been made to reduce the adverse effects caused by contaminants reaching these components, such attempts have been incapable of completely eliminating this problem.

A further difficulty which has recently arisen and has caused consumers to become increasingly concerned is the requirement that all secured locks may be broken by customs officers and/or inspection or security personnel in order to gain access to luggage which is deemed suspicious. Under security regulations that have recently been implemented, all luggage must be scanned or inspected to prevent the transportation of potentially dangerous items or products which are deemed to be undesirable. In those instances when the luggage is scanned and further visual inspection is required, the inspectors have the authority to open the luggage for visual inspection, including physically breaking any lock which may be on the luggage and cannot be opened by the customs officers.

Consequently with these new regulations presently being implemented, all prior art lock systems which are incapable of being opened by inspectors and/or security personnel are subject to being physically broken, in order to gain access to any luggage which needs to be visually inspected. As a result, consumers will be faced with the possibility that any lock system employed to protect the contents of the suitcase can be physically removed by security personnel, leaving the luggage completely unprotected during the remainder of the trip.

Furthermore, even in those instances when security personnel are able to open a padlock in order to visually inspect the contents of the suitcase, the consumer is unable to know with certainty whether or not a particular locked suitcase had been visually inspected by the security personnel. Without any positive indication regarding the security personnel's activity with a particular piece of luggage, the consumer is unable to know whether any missing or damaged item in the suitcase may have resulted during a security inspection.

Therefore, it is a principal object of the present invention to provide a padlock which can be opened by employing either a user key or a master key and incorporates an automatically initiated positive indicator or signal for informing the consumer whenever the padlock has been opened using the master key.

Another object of the present invention is to provide a padlock having the characteristic features described above which is easily produced and provides the user with complete control over re-setting of the indicator.

Another object of the present invention is to provide a padlock having the characteristic features described above which automatically locks the indicator/signal in its raised position once the indicator/signal has been activated.

Another object of the present invention is to provide a padlock having the characteristic features described above which also provides an indicator or signal which is highly visible and easily seen by the user.

A further object of the present invention is to provide a padlock having the characteristic features described above which requires a separate key for resetting the indicator or signal for enabling only the user to reset the indicator or signal when the lock has been opened.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, key operated padlock is achieved which incorporates a positive indicator which provides notice to the user whenever the padlock is opened by a master key. In addition, the positive indicator is only able to be reset by the owner, thereby eliminating the possibility of having the user of the master key reset the indicator display.

Furthermore, the padlock of the present invention incorporates a cylinder plug which is rotationally mounted in the cylinder housing and is constructed from two separate and independent components. In this way, the cylinder plug is capable of being manufactured by die casting in a large scale production operation, thereby eliminating the need for individually drilling, cutting, and machining the cylinder plug, as is required in conventional prior art constructions. In this way, substantial reduction of manufacturing costs are realized.

In accordance with the present invention, a housing and generally conventional J-shaped shackle are employed, with one portion of the housing cooperatively associated with the longer leg of the shackle. In addition, the cylinder housing and cylinder plug are mounted in the housing directly adjacent the longer leg of the shackle, with the cylinder plug rotatable relative to the housing, in response to the insertion of the associated key. As is well known in the industry, tumblers are mounted in the cylinder plug and must be properly aligned to enable rotation of the cylinder plug to occur. In addition, in accordance with the present invention, two separate key constructions are employed, one construction being a user key, while the other construction is a master key for use by customs or security personnel. In this way, the owner of the padlock employs the user key, while the security personnel are given the master key which is constructed for opening numerous padlocks, each of which has separate and distinct user keys.

By employing the padlock construction of the present invention, all of the difficulties and drawbacks which travelers face under newly enacted regulations are completely overcome. As detailed above, recently enacted regulations empower customs officers and/or inspection and security personnel to physically break any secured lock on the suitcase in order to gain access to a suitcase which is believed to contain suspicious material. However, by employing the padlock of the present invention, the possibility of having a lock completely broken by customs and/or security personnel is totally prevented.

By employing the padlock of the present invention, a master key is created which is able to open the key controlled padlock of the present invention, enabling customs officers and/or security personnel to gain access to any piece of luggage to be open for further visual inspection. In this way, physically breaking a lock is totally eliminated and, once the visual inspection has been completed, the padlock would be replaced on the luggage and locked in position, in order to assure that the contents remain secure throughout the remainder of the trip.

Furthermore, in accordance with the present invention, the master key is constructed with an overall length which is greater than the length of the user key. This additional length causes a portion of the padlock to be telescopically moved whenever the master key is inserted into the cylinder plug. In addition, once the master key is rotated, in addition to releasing the shackle for enabling the padlock to be removed, an alert flag or alert indicia is activated and prominently displayed for enabling the owner to immediately know that the padlock has been opened by the master key. In this way, the user is assured of receiving positive notification whenever the padlock has been opened by security personnel using the master key.

Furthermore, by employing the padlock of the present invention, security personnel are incapable of resetting the alert notifier. As a result, the consumer is assured that any time the padlock is open using the master key, the alert notifier will be visible for informing the user that the padlock had been opened.

In a further feature of the padlock of the present invention, a minimum number of components are employed, in combination with the housing and the movable shackle, in order to produce the desired, uniquely constructed padlock. In this way, the padlock is capable of being quickly assembled into a final product. As a result, a construction is attained which is capable of being manufactured at competitive prices, while providing a high quality, highly effective padlock which eliminates any degradation due to exposure to environmental contamination. Furthermore, the incorporation of a cylinder plug constructed from two separate and independent components provides a further enhanced cost savings in the overall production of the padlock.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 17 is a perspective view of an alternate embodiment of the padlock of the present invention depicting a key operated padlock with a visual indicator shown with the front housing panel removed;

FIG. 18 is a front elevation view of the key operated padlock with the visual indicator embodiment of FIG. 17;

FIG. 19 is a cross-sectional plan view of the key operated padlock with visual indicator taken along line 17-17 of FIG. 18;

DETAILED DISCLOSURE

Figure 1:
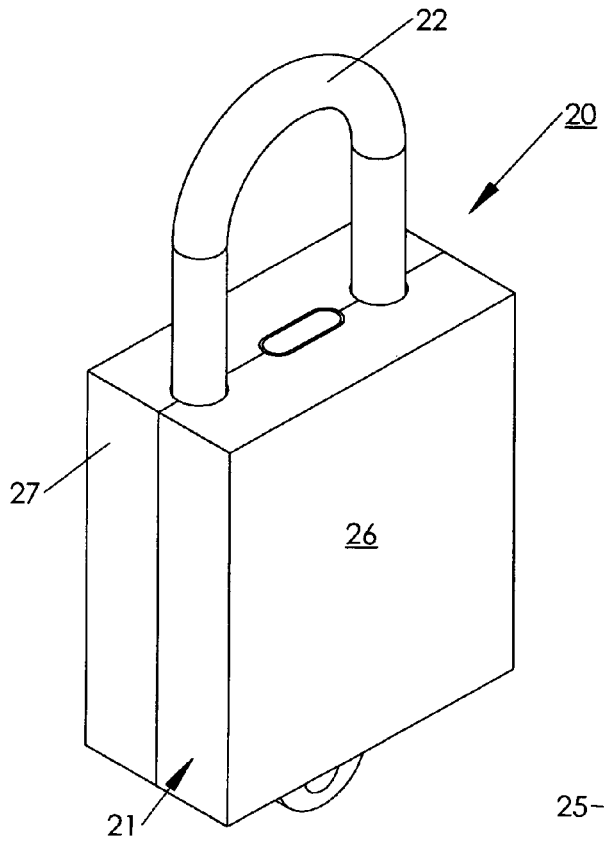
FIG. 1 is a perspective view of the key operated padlock with a visual indicator of the present invention shown in the locked position.

By referring to FIGS. 1-21, along with the following detailed discussion, the construction and operation of two alternate preferred embodiments of key operated padlock 20 of the present invention are presented and can best be understood. In the drawings and in the following detailed disclosure, the preferred embodiments of the present invention are fully detailed. However, this disclosure is provided for exemplary purposes only and, since the present invention can be implemented using further alternate constructions, it is intended that all such alternate constructions are within the scope of the present invention.

In FIGS. 1-19, one preferred embodiment of padlock 20 is shown incorporating a minimum number of principal components, thereby achieving a key operated padlock which provides a positive alert indicator whenever the padlock has been opened under specific circumstances, while also substantially reducing the complexity found in the construction of most prior art padlocks. In this way, the present invention provides a highly effective, commercially desirable construction which is capable of being produced at a competitive cost, while also providing the unique attributes desired by consumers in a padlock, as well as all of the locking and theft deterrent features typically incorporated in more expensive padlocks.

As depicted, in this preferred embodiment, key operated padlock 20 incorporates housing 21 and J-shaped shackle 22 which is cooperatively associated with housing 21. In addition, shackle 22 incorporates long leg 23 and short leg 24. Furthermore, in the preferred construction, long leg 23 of shackle 22 incorporates notched zone 25 formed along the length thereof wherein long leg 23 comprises a diameter substantially less than the diameter of long leg 23 in other locations.

In the preferred construction, housing 21 incorporates mating sections 26 and 27 which effectively form the front and rear portions of housing 22. Although this construction is preferred, housing 21 may be configured in any alternate construction desired.

As shown, housing 21 incorporates top surface 28 and bottom surface 29, along with elongated passageway 30 which is formed in housing 21 and extends from entry portal 31 formed in top surface 28 of housing 21, and ending inside housing 21 directly adjacent bottom surface 29. In addition, housing 21 also incorporates a substantially shorter passageway 32 which is constructed for cooperating with shorter leg 24 of shackle 22 and incorporates entry portal 33 formed in top surface 28 of housing 21.

In the preferred construction, long leg 23 of shackle 22 is constructed for being pivotally mounted within passageway 30 of housing 21, while also being axially movable longitudinally within passageway 30. In order to control the axial movement of leg 23 of shackle 22 relative to passageway 30 of housing 21, passageway 30 incorporates ledges 35 and 36 formed therein and positioned below entry portal 31 and constructed for cooperating with notched zone 25 of shackle 22. By employing ledges 35 and 36, the axial movement of leg 23 of shackle 22 is limited to the overall length of notched zone 25.

Finally, in order to enable shackle 22 to axially move automatically, when released, spring member 37 is mounted in the base of passageway 30 in controlling contact with the terminating end of leg 23 of shackle 22. In this way, whenever shackle 22 is released from its locked mode, as detailed below, shackle 22 automatically moves axially within passageway 30, limited by the movement of notched zone 25 between ledges 35 and 36.

Key operated padlock 20 also incorporates receiving zone 40 formed in housing 21 and dimensioned for receiving and securely retaining cylinder housing 41. In addition, cylinder plug 42 is constructed for being rotationally movable with cylinder housing 41 in a manner generally known in the art. However, as is more fully detailed below, cylinder plug 42 is constructed in a unique, two part construction, which enables cylinder plug 42 to be constructed and assembled at a substantially reduced cost.

In this embodiment of the present invention, cylinder plug 42 is constructed for being rotationally movable within cylinder housing 41 in response to the insertion of a cooperating key member into a receiving slot formed in cylinder plug 42, extending from bottom surface 43 through to top surface 44. In addition, top surface 44 of cylinder plug 42 incorporates upstanding boss 45 which is securely mounted to surface 44 and extends upwardly therefrom. Furthermore, as shown throughout the drawings, padlock 20 incorporates an elongated spring biased arm member 46 which is mounted in housing 21 in abutting contact with upstanding boss 45 and long leg 23 of shackle 22.

Figure 2:
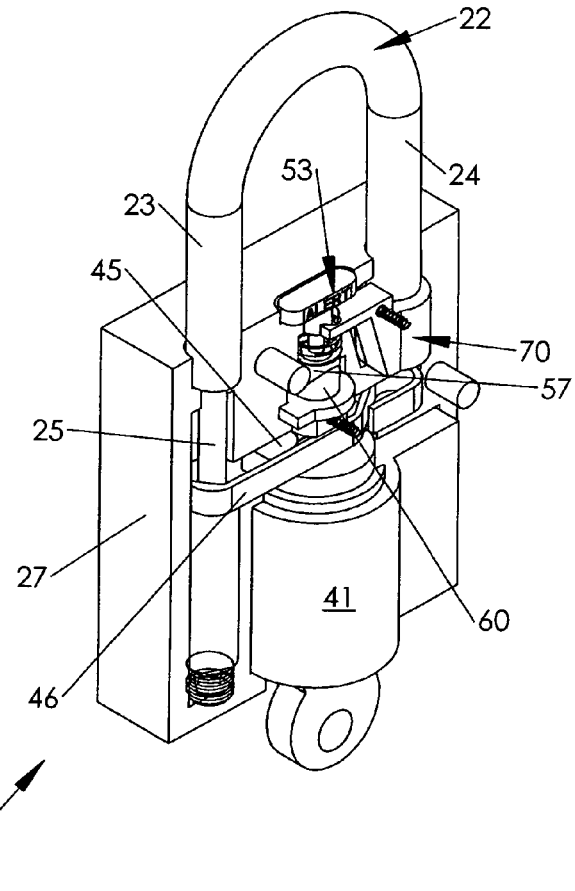
FIG. 2 is a perspective view of the key operated padlock with a visual indicator of FIG. 1 shown with the front housing panel removed.
Figure 3:
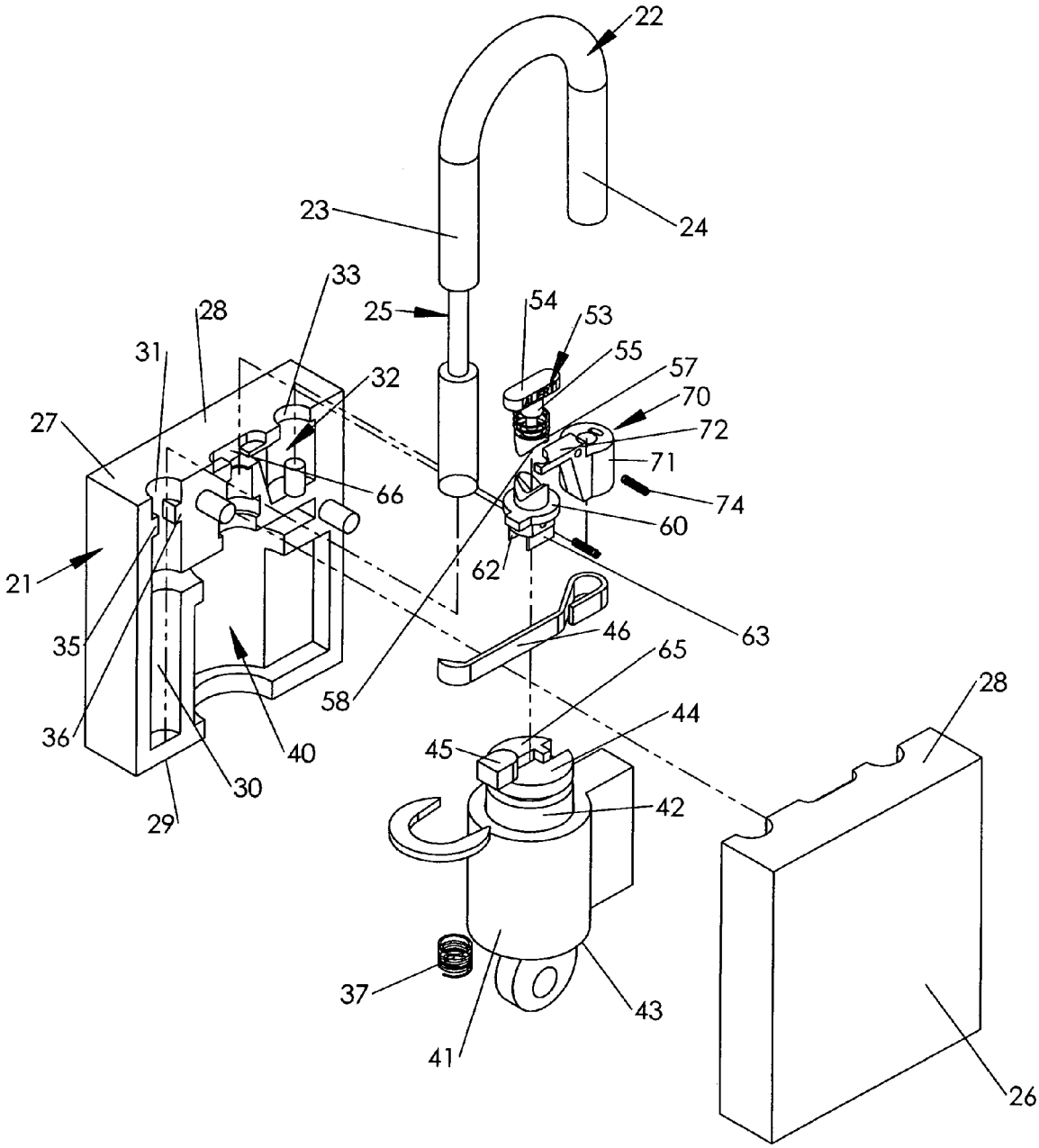
FIG. 3 is an exploded perspective view of the key operated padlock with a visual indicator of FIG. 1.
Figure 5:
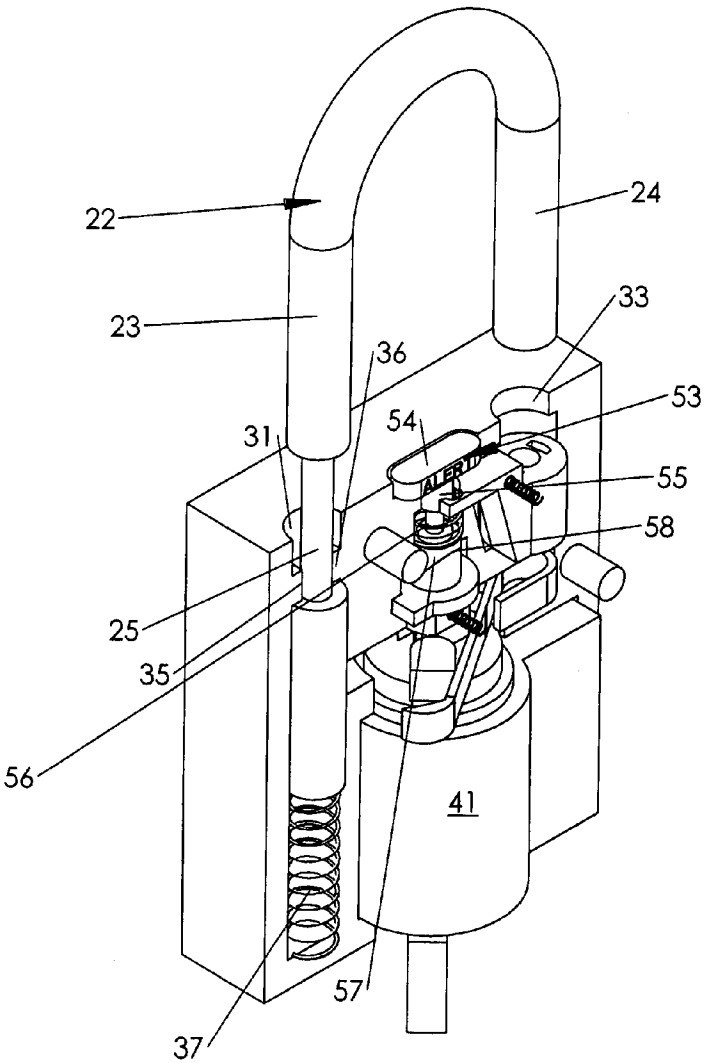
FIG. 5 is a perspective view of the key operated padlock with a visual indicator of FIG. 4.
Figure 4:
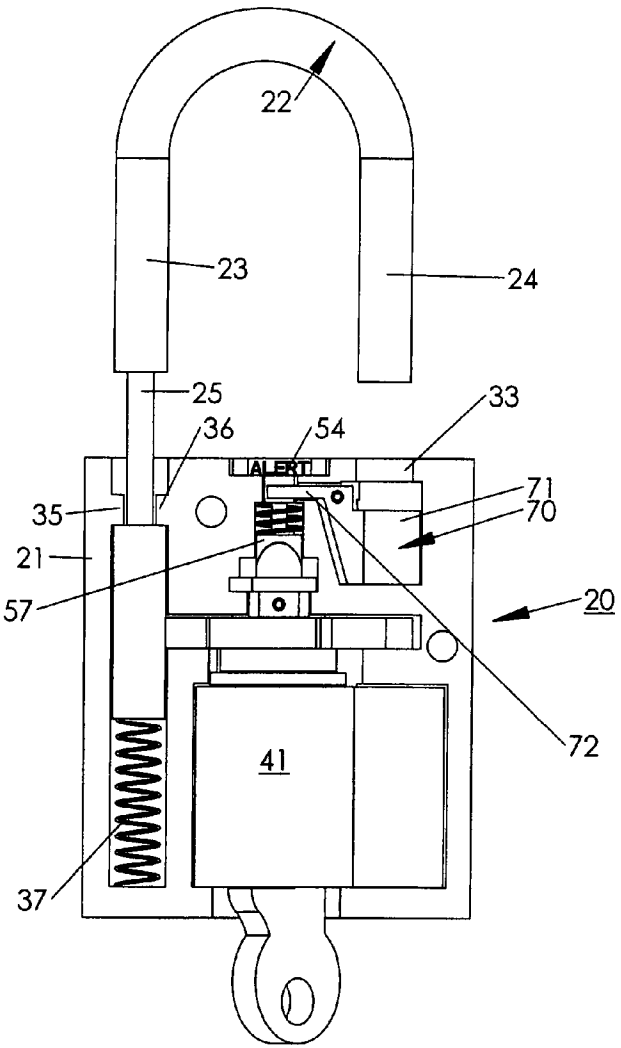
FIG. 4 is a front elevation view of the key operated padlock with a visual indicator of FIG. 2 shown in the unlocked position using the user key.
Figure 7:
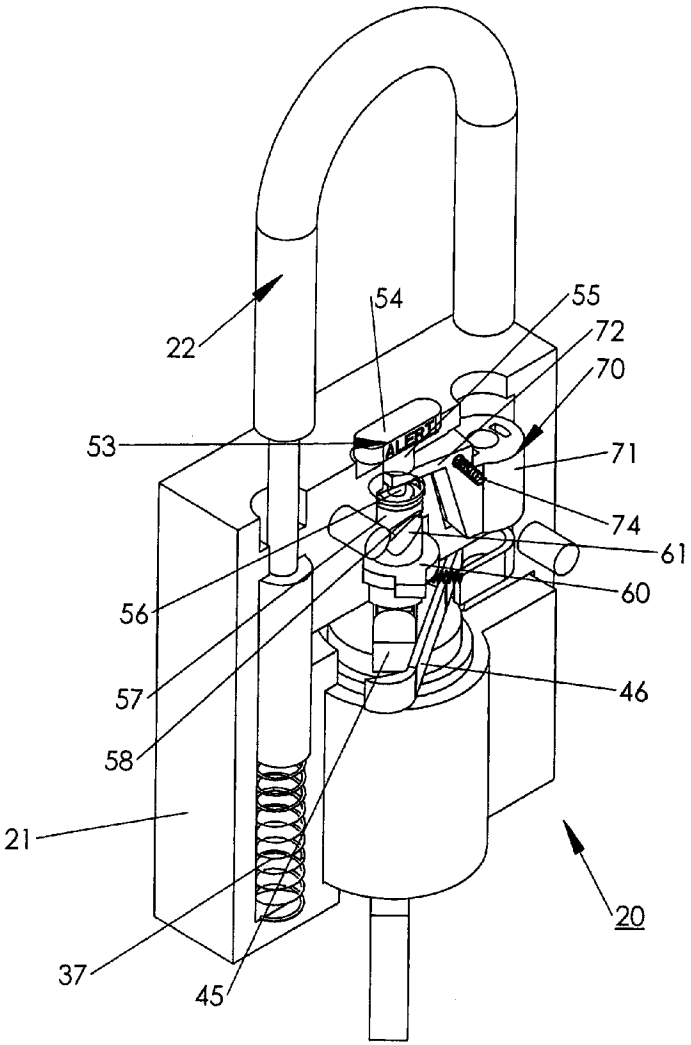
FIG. 7 is a perspective view of the key operated padlock with a visual indicator of FIG. 6.
Figure 6:
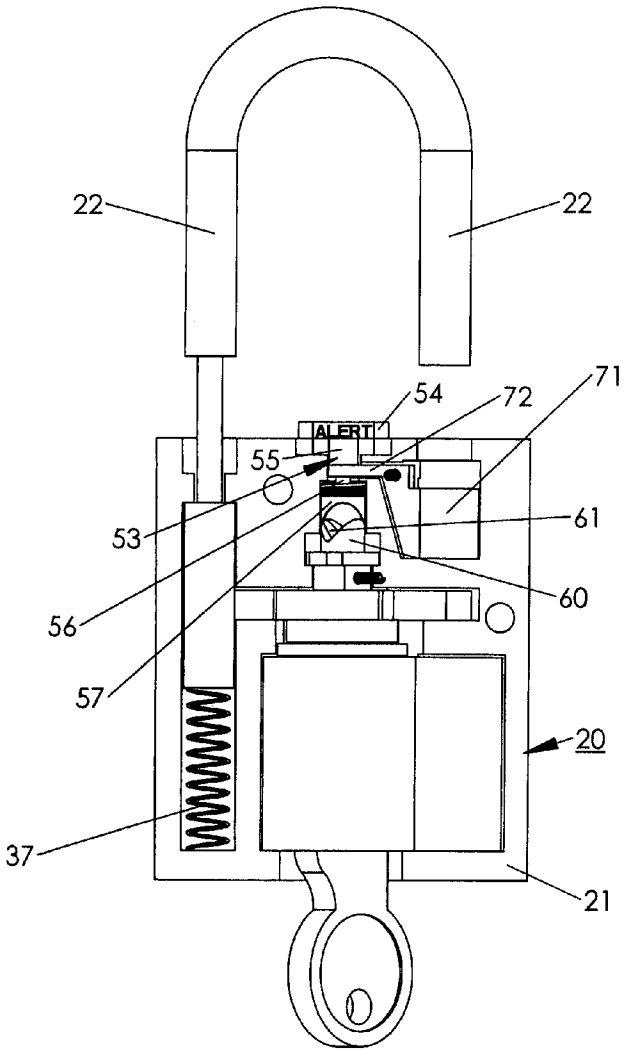
FIG. 6 is a front elevation view of the key operated padlock with a visual indicator of FIG. 5 shown in the unlocked position using the master key, with the alert indicator activated.

As shown in FIG. 2, when padlock 20 is in the locked position, spring biased arm 46 is positioned within notched zone 25 of leg 23 of shackle 22. As a result, shackle 22 is retained in the locked position since its axial movement is prevented by the position of arm member 46. However, whenever cylinder plug 42 is arcuately rotated, upstanding boss 45 of top surface 44 of cylinder plug 42 is brought into engagement with spring biased arm 46, causing arm 46 to move outwardly therewith. This movement forces arm 46 to become disengaged from notched zone 25 and effectively releases shackle 22, enabling shackle 22 to automatically move into its unlocked position.

Figure 9:
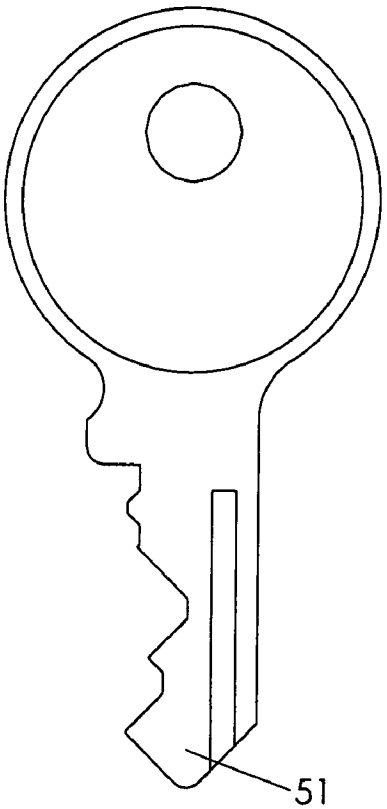
FIG. 9 is a top plan view of the user key.
Figure 8:
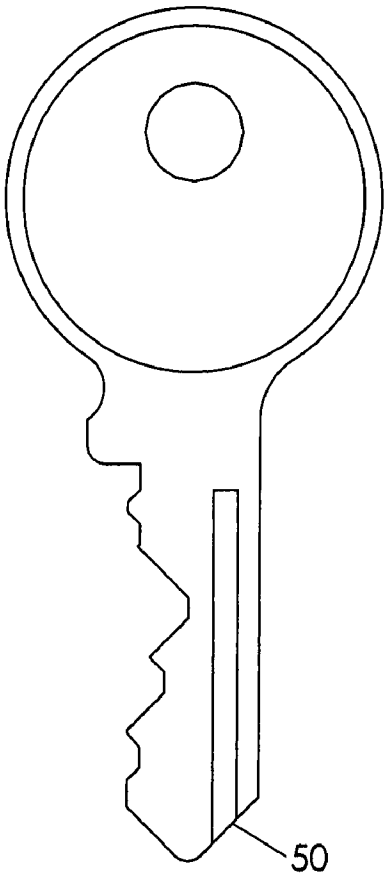
FIG. 8 is a top plan view of the master key.
Figure 13:
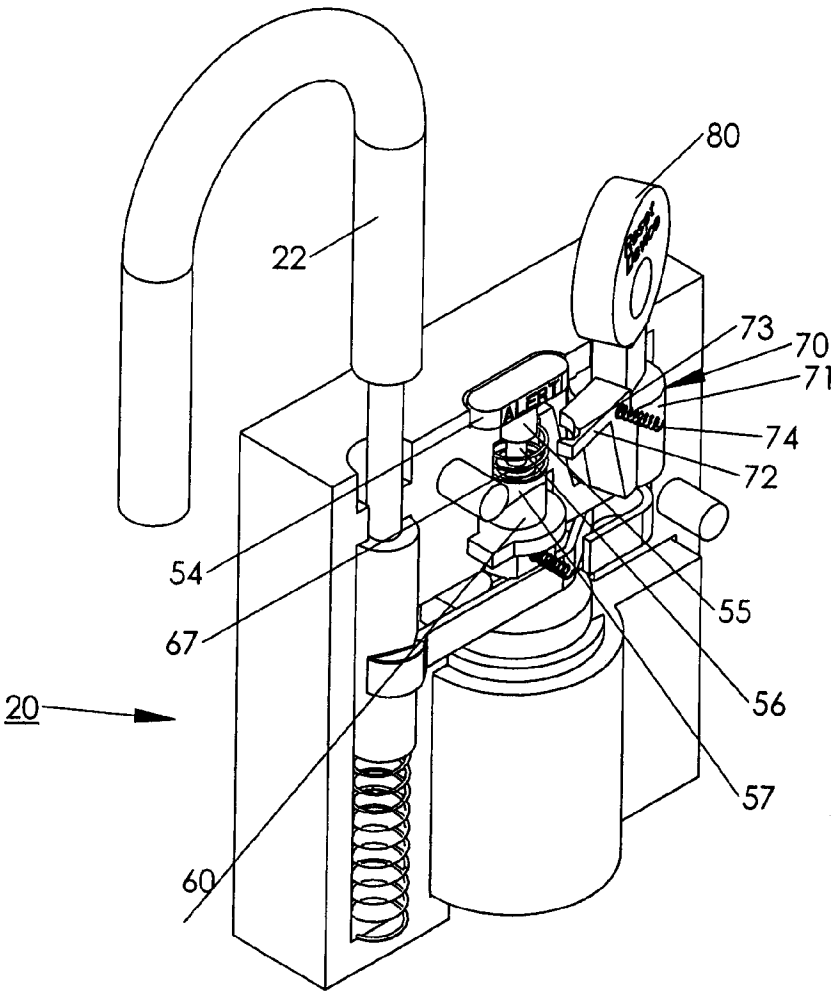
FIGS. 12 and 13 are perspective views of the key operated padlock with a visual indicator shown with the front housing panel removed and in the process of having the visual indicator reset.

In accordance with the present invention, two separate and independent key members are constructed for padlock 20. As depicted in FIGS. 8 and 9, key members 50 and 51 are both constructed and configured for cooperating with cylinder plug 42 to obtain the desired rotation of the cylinder plug 42 within cylinder housing 41.

As is evident from a review of FIGS. 8 and 9, key member 50 comprises an overall length which is greater than key member 51, with each key member incorporating a plurality of cut out zones constructed for cooperating with the tumblers incorporated within cylinder plug 42. Key member 51 is constructed as the user's or owner's key which the owner of padlock 20 would employ for locking and unlocking padlock 20. In the present invention, key member 51 comprises a shorter length than key member 50 and employs three cut out zones, while key member 50 incorporates four cut out zones. In accordance with the present invention, key member 50 represents the master key which is employed by security personnel for opening padlock 20, if necessary. In this regard, master key 50 is constructed for opening numerous padlocks 20, while separate and independent user keys 51 are required for opening each padlock.

In addition to incorporating a key receiving slot which extends through cylinder plug 42, cylinder plug 42 also incorporates a plurality of spring biased tumblers which are constructed for cooperating with cut out zones formed on keys 50 and 51. In this construction, as is known in the prior art, the tumblers prevented the arcuate movement of cylinder plug 42 unless all of the tumblers are positioned in a precise, predetermined alignment and/or arrangement. When the desired aligned position is attained, cylinder plug 42 is capable of being arcuately rotated relative to cylinder housing 41.

In addition, in order to achieve the precisely desired aligned position for enabling cylinder plug 42 to be arcuately rotated, key members 50 and 51 are employed for axially positioning each tumbler in the precisely desired, predetermined position. In addition, key members 50 and 51 provide the necessary leverage for enabling cylinder plug 42 to be arcuately pivoted.

Once either key member 50 or 51 is inserted into the receiving slot of cylinder plug 42, the tumblers incorporated in cylinder plug 42 are aligned in the precisely desired predetermined position, enabling cylinder plug 42 to be arcuately rotated. This arcuate rotation causes upstanding boss 45 formed on top surface 44 of cylinder plug 42 to be arcuately moved along with cylinder plug 42, thereby moving spring biased arm member 46 laterally, releasing shackle 22 from its locked position and allowing shackle 22 to be automatically raised into its unlocked position.

In this regard, both key members 50 and 51 operate in this manner in order to enable shackle 22 to be released, allowing padlock 20 to be opened. However, as detailed below, the use of master key 50 also activates indicator assembly 53, causing alert indicator 54 to be released and locked in its raised, visible position.

By referring to FIGS. 3-7, along with the following detailed discussion, the construction and operation of indicator assembly 53 can best be understood. In the preferred embodiment of the present invention, padlock 20 incorporates indicator assembly 53 which comprises alert indicator 54, mounted to collar 55, which is mounted to support shaft 56. In addition, these components are supportingly maintained on indicator base 57. As clearly shown in the drawings, indicator base 57 incorporates bottom surface 58 which is defined by a groove or arcuate, curved shape.

In order to provide the desired activation of indicator assembly 53, padlock 20 also incorporates control member 60 mounted between indicator base 57 and top surface 44 of cylinder plug 42. In the preferred construction, control member 60 incorporates a top surface 61 which comprises a groove or arcuate, curved shape constructed for nested, cooperative interengagement with the groove/arcuate shape of bottom surface 58 of indicator base 57. In addition, control member 60 also incorporates two panels or wall members 62 and 63, extending from the bottom surface thereof and positioned in juxtaposed, spaced, parallel, facing relationship with each other. In the preferred construction, wall members 62 and 63 are mounted in contact with top surface 44 of cylinder plug 42, with wall members 62 and 63 positioned directly adjacent or straddling exit slot 65 of cylinder plug 42.

By employing this construction, the use of user key 51 is capable of causing cylinder plug 42 to arcuately rotate in order to release shackle 22 in the matter detailed above. However, whenever master key 50 is employed, which is constructed with an overall length greater than the length of the user key 51, the distal end of master key 50 protrudes through slot 65 of cylinder plug 42, entering between panels 62 and 63. As a result, whenever master key 50 is inserted into cylinder plug 42, cylinder plug 42 is capable of rotating in order to release shackle 22, while also causing control member 60 to rotate simultaneously therewith, due to the arcuate movement of the distal end of master key 50 in cylinder plug 42 and the driving engagement of the distal end with panels 62 and 63.

In this regard, whenever control member 60 is rotated due to the movement of master key 50, the grooved top surface 61 thereof is rotated therewith, causing the top surface 61 to interact with grooved bottom surface 58 of indicator base 57. Due to the complementary ramped, sloping engagement of bottom surface 58 of indicator base 57 with top surface 61 of control member 60, the arcuate movement of control member 60 causes indicator base 57 to be vertically moved upwardly. This upward movement forces alert indicator 54 to exit from storage zone 66 of housing 21, enabling alert indicator 54 to be readily visible.

In order to assure that the desired movement of indicator assembly 53 is achieved in response to the arcuate movement of master key 50, indicator assembly 53 also incorporates biasing spring 67 which is mounted about support shaft 56 and continuously exerts a downward biasing force on indicator base 57. In this way, indicator base 57 is maintained in contact with control member 60, providing assurance that the pivoting movement of control member 60 will cause bottom surface 58 of indicator base 57 to be forced upwardly, raising alert indicator 54 into the desired, readily visible position.

In order to provide a construction wherein the removal of master key 50 from padlock 20 does not cause alert indicator 54 to return to storage zone 66, which would prevent the owner of padlock 22 from immediately knowing that padlock 20 has been opened by master key 50, padlock 20 incorporates indicator lock assembly 70. In the preferred construction, lock assembly 70 incorporates support base 71 and arm 72 which extends outwardly from base 71. In addition, arm 72 incorporates locking finger 73 mounted at its distal end. The final element incorporated into lock assembly 70 is spring 74 which is mounted on the side edge of arm 72 and arcuately biases arm 72 into a desired position.

By employing this construction, locking finger 73 of arm 72 is normally maintained engaged about collar 55 of indicator assembly 53. However, whenever indicator 53 has been activated an alert indicator 54 is moved upwardly into this readily visible position, collar 55 moves upwardly bringing support shaft 56 into alignment with locking finger 53 of arm 72. In addition, since spring 74 continuously biases arm 72 towards support shaft 56, locking finger 73 and arm 72 effectively engage support shaft 56, locking alert indicator 54 in the raised, visible position, regardless of the position of control member 60.

In this way, alert indicator 54 continues to be maintained in the raised, visible position, even after master key 50 has been removed from padlock 20. As a result, the user is immediately placed on notice that padlock 20 has been opened by security personnel using master key 50.

In another feature of the present invention, the movement of alert indicator 54 from its raised, visible position back to its retracted position within housing 21 of padlock 20 is designed to require the use of a separate, independent reset key which is provided to only the user. In this way, the user is assured that security personnel using master key 50 would be incapable of resetting alert indicator 54 in order to prevent the user from knowing that padlock 20 had been opened by use of the master key.

Figure 11:
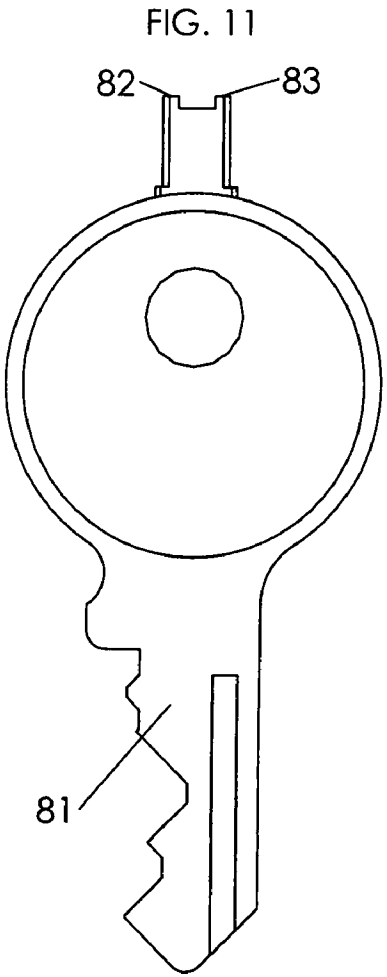
FIG. 11 is a top plan view of a combined user key and reset key.
Figure 10:
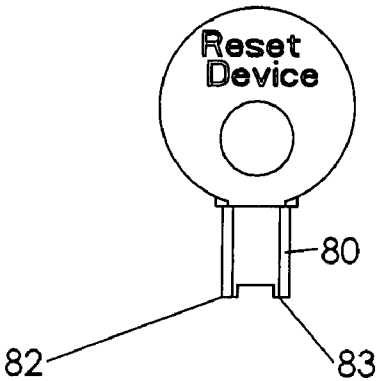
FIG. 10 is a top plan view of a reset key.

In FIG. 10, one embodiment of reset key 80 is depicted, while FIG. 11 depicts an alternate combination key embodiment 81, which combines in a single product, both the user key and the reset key. As is evident from a review of both FIGS. 10 and 11, reset key 80 and the reset portion of key 81 both comprise unique constructions which are required for mating with lock assembly 70 in order to reset alert indicator 54. In particular, both keys 80 and 81 incorporate finger members 82 and 83 extending from the terminating end thereof, with finger members being constructed for mating interengagement with receiving holes formed in support base 71 of lock assembly 70. By referring to FIGS. 12 and 13, along with the following detailed discussion, the resetting operation can best be understood.

Figure 12:
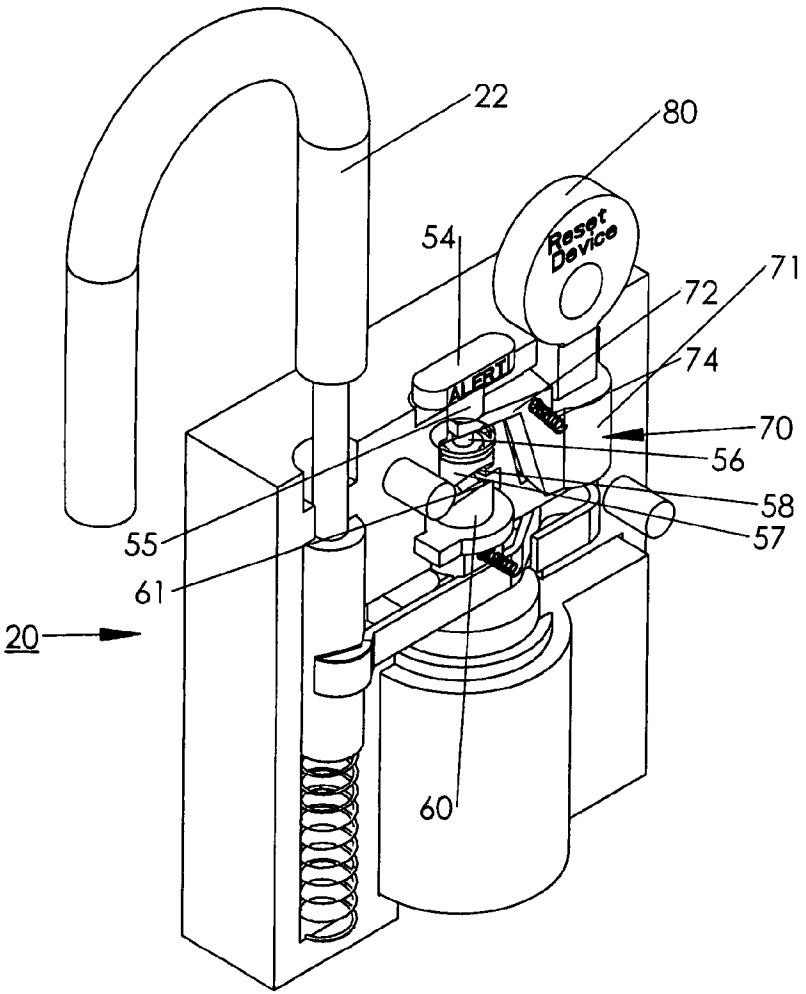

In FIG. 12, padlock 20 is shown in the typical position after master key 50 has been employed to release shackle 22. In this position, alert indicator 54 is raised and visible, with locking finger 73 of arm 72 engaged with support shaft 56 and in abutting holding contact below collar 55. As a result, alert indicator 54 is incapable of moving downwardly, back to its original position. In addition, as shown in FIG. 12, bottom surface 58 of indicator base 57 is spaced away from top surface 61 of control member 60. In this position, the grooved or arcuately contoured features of these surfaces are clearly visible.

The first step in resetting alert indicator 54 is to insert key 80, or the corresponding portion of key 81, through portal 33 into passageway 32 of housing 21. When fully inserted, fingers 82 and 83 of reset key 80/81 become engaged within the cooperating holes formed in the top surface of support base 71. Once fully inserted, reset key 80/81 is arcuately pivoted, causing support base 71 to arcuately pivot therewith.

When support base 71 is pivoted due to the movement of key 80/81, locking finger 73 of arm 72 is disengaged from support shaft 56 and collar 55, effectively releasing alert indicator 54 and enabling alert indicator 54 to move downwardly into its original position. This downward movement is caused by spring 67, which may also be assisted by the user pushing alert indicator 54 downward.

Once alert indicator 54 is returned to its original position, reset key 80/81 is removed, and biasing spring 74 causes arm 72 to return to its original position, with locking finger 73 engaged with collar 55. Once reset key 80/81 has been removed, padlock 20 is ready to be reused by securing padlock 22 to any desired product.

As is evident from the foregoing detailed discussion, padlock 20 provides a key operated construction which is capable of enabling a user to secure padlock 22 to any desired product, while also being assured that padlock 20 will provide a positive indication to the user any time padlock 20 is opened by customs or security personnel using a master key. In this way, one potential cause for any damaged or missing articles that may be found in a suitcase to which padlock 20 was affixed will be known to the user. In addition, as is evident from the foregoing detailed discussion, the present invention provides a key operated padlock construction which overcomes virtually all prior art difficulties and drawbacks.

In addition as is more fully detailed below, the embodiment of the alert providing, key operated padlock construction detailed above can also be employed as an integral part of a padlock having a dual locking system. Typically, a fully integrated, dual locking padlock construction incorporates a combination controlled section and a key controlled section, both of which are integrally mounted in the housing. As is readily apparent from FIG. 16, the precise construction defined above and shown in FIGS. 1-15 is easily integrated into a housing which also incorporate a combination controlled locking section.

As a result, by employing this modified construction, a fully integrated, dual locking padlock is realized which provides an indicator to the consumer whenever the key operated portion of the padlock is employed using a master key. In this way, the consumer is able to employ a padlock which can be opened either by a user key or by a user created combination, while still being provided with a positive alert indication whenever a master key is used to open the padlock using the key operated portion of the padlock. As detailed above, the master key is typically in the possession of security personnel for opening suitcases and the like for purposes of inspection.

In FIGS. 17-21, an alternate preferred embodiment of the present invention is depicted. By referring to these figures, along with the following detailed discussion, the construction and operation of this alternate preferred embodiment can best be understood. In addition, for purposes of convenience, similar reference numerals are employed in FIGS. 17-21 for referring to similar components incorporated into this embodiment of padlock 20. In this way, the similarity between these two embodiments is readily apparent. Furthermore, in order to prevent repetition in the disclosure of this embodiment of the present invention, detailed discussions regarding the construction and operation of similar components which have been fully detailed above are not provided, and the foregoing detailed disclosure is incorporated herein by reference.

In the construction of this embodiment of the present invention, key operated padlock 20 incorporates housing 21 and J-shaped shackle 22 which is cooperatively associated with housing 21. In addition, shackle 22 incorporates long leg 23 and short leg 24. Furthermore, in the preferred construction of this embodiment, long leg 23 of shackle 22 incorporates notched zone 25 formed along the length thereof wherein leg 23 comprises a diameter substantially less than the diameter of leg 23 in other locations.

In order to control the movement of shackle 22, this embodiment of padlock 20 incorporates locking plate 100 mounted in housing 21 and positioned for longitudinal movement substantially perpendicularly to long leg 23 of shackle 22. In addition, locking plate 100 incorporates an articulately curved cut-out zone 101 constructed for mating cooperating engagement with notched zone 25 of leg 23 of shackle 22.

As clearly shown in the drawings, when cut-out zone 101 is engaged with notched zone 25 of shackle 22, shackle 22 is maintained in its locked position, fully engaged with housing 21. As shown, cut-out zone 101 peripherally surrounds the smaller diameter portion of notched zone 25, while locking plate 100 is in contact with the larger diameter portion of leg 23 of shackle 22. As a result, when in this position, shackle 22 is unable to move axially within housing 21 in spite of the biasing forces being exerted by spring member 37. Furthermore, since notched zone 25 is employed in this embodiment for cooperating interengagement with cut out zone 101 of locking plate 100, the overall axial length of notched zone 25 is substantially less than the axial length of notched zone 25 in the embodiment detailed above.

In order to control the axial travel distance of leg 23 of shackle 22 relative to housing 21, locking washer 102 is mounted near the terminating end of long leg 23 of shackle 22, directly adjacent spring member 37. In addition, locking plate 100 is cooperatively associated with spring member 103 for continuously biasing locking plate 100 into engagement with leg 23 of shackle 22. As a result, cut-out zone 101 of locking plate 100 is typically maintained securely engaged with notched zone 25 of leg 23, until a counteracting force, as detailed below, acts upon locking plate 101.

When a counteracting force longitudinally moves locking plate 100, in order to withdraw cut-out zone 101 from engagement with notched zone 25, shackle 22 is released from locked engagement with locking plate 100, enabling shackle 22 to be moved into its housing disengaged position. Furthermore, although the longitudinal movement of locking plate 100 withdraws cut out zone 101 from engagement with notched zone 25, cut out zone 101 remains aligned with the outer surface of leg 23 of shackle 22.

As a result, as leg 23 axially moves upwardly in housing 21 due to the force of spring member 37, locking washer 102 engages with the surface of locking plate 100, thereby limiting the axial movement of shackle 22 when in its unlocked or released configuration. However when shackle 22 is moved into its housing disengaged position, short leg 24 of shackle 22 is removed from engagement within portal 33 of housing a 21, thereby enabling padlock 20 to be removed from the particular item to which padlock 20 had been secured.

As with the embodiment detailed above, this embodiment of key operated padlock 20 also incorporates a receiving zone formed in housing 21 dimensioned for receiving and securely retaining cylinder housing 41. In addition, cylinder plug 42 is constructed for being rotationally movable in cylinder housing 41 in the manner fully detailed above, the substance of which is incorporated herein by reference.

In this embodiment, as previously described, cylinder plug 42 is rotationally movable within cylinder housing 41 in response to the insertion of a cooperating key member into receiving slot 65 formed in cylinder plug 42, and extending from the bottom surface thereof through to top surface 44. In addition, top surface 44 of cylinder plug 42 incorporates upstanding boss 45 which is securely mounted to surface 44 and extends upwardly therefrom. However, in this embodiment, upstanding boss 45 is constructed for controlled movement of spring biased locking plate 100.

As depicted, locking plate 100 incorporates an enlarged arcuately curved open zone 107 within which abutment wall 108 is formed. As a result, whenever an appropriate key member is inserted into cylinder plug 42, cylinder plug 42 is rotated relative to cylinder housing 41. This arcuate, rotational movement causes upstanding boss 45 to be arcuately moved into contact with abutment wall 108 and, when further rotation occurs, causes locking plate 100 to be longitudinally moved against the biasing forces of spring member 103. As detailed above, this longitudinal movement removes cut-out zone 101 from engagement with notched zone 25, enabling shackle 22 to be released.

In the preferred construction of this embodiment of the present invention, abutment wall 108 is positioned at about 90° from the initial position of upstanding boss 45. As a result, boss 45 must pivot through an arc of about 90° before contacting abutment wall 108. As is more fully detailed below, this positioning provides assurance that indicator assembly 53 is activated prior to the release of shackle 22 from locked engagement with housing 21. In this way, the user is assured that indicator assembly 53 is fully activated and displayed before padlock 20 is opened.

In addition to longitudinal movement of locking plate 100 whenever a suitable key is inserted into cylinder plug 42 and rotated therein, the arcuate rotational movement of cylinder plug 42 also causes indicator assembly 53 to be activated whenever a master key is used to open padlock 20. In this way, the user is alerted to the fact that a master key has been employed to release padlock 20 for inspecting the suitcase or other product to which padlock 20 is secured.

As fully detailed above, both embodiments of the present invention employ key members of different working lengths in order to provide the desired operation. In this regard, the foregoing detailed discussion found in reference to the previous embodiment is equally applicable to this alternate preferred embodiment and is incorporated herein by reference. In this regard, cut out zones are formed on keys 50 and 51 for enabling cylinder plug 42 to be arcuately rotated. In addition, master key 50 is constructed with an overall working length greater than the overall working length of user key 51, for enabling master key 50 to activate indicator assembly 53 and cause alert indicator 54 to be released and locked in its raised, visible position.

Furthermore, by constructing indicator assembly 53 in a manner substantially identical to the construction detailed above, indicator assembly 53 comprises alert indicator 54 mounted to collar 55, which is mounted to support shaft 56. In addition, these components are supportingly maintained on indicator base 57. In this embodiment, indicator base 57 preferably comprises a bottom surface 58 which is defined by V-shaped surface 58.

In order to provide the desired activation of indicator assembly 53, padlock 20 also incorporates control member 60 which is mounted between indicator base 57 and top surface 44 of cylinder plug 42. In the preferred construction of this embodiment, control member 60 incorporates a top surface 61 which comprises a V-shape constructed for nested, cooperative interengagement with the V-shaped bottom surface 58 of indicator base 57.

In addition, control member 60 also incorporates two panels or wall members 62 and 63, extending from the bottom surface thereof and positioned in juxtaposed, spaced, parallel, facing relationship with each other. In the preferred construction, wall members 62 and 63 are mounted in contact with top surface 44 of cylinder plug 42, with wall members 62 and 63 positioned directly adjacent or straddling slot 65 of cylinder plug 42.

By employing this construction, the use of user key 51 is capable of causing cylinder plug 42 to arcuately rotate in order to release a shackle 22 in the manner detailed above. However, whenever master key 50 is employed, which is constructed with an overall working length greater than the working length of user key 51, the distal end of master key 50 protrudes through slot 65 of cylinder plug 42, entering between panels 62 and 63.

As a result, whenever master key 50 is inserted into cylinder plug 42, cylinder plug 42 is capable of rotating and, during the first 90° of arcuate movement, the distal end of master key 50 causes indicator assembly 53 to be activated. This activation is achieved by the camming engagement of top surface 61 of control member 60 with bottom surface 58 of indicator base 57. As a result of the construction of these elements, the arcuate movement of control member 60, due to the rotation of cylinder lug 42, causes indicator base 53 and alert indicator 54 to move upwardly.

After the rotation of cylinder plug 42 through an arc of about 90°, upstanding boss 45 contacts abutment wall 108 and causes locking plate 100 to be longitudinally moved, releasing shackle 22 from locked engagement in housing 21 and allowing padlock 20 to be opened. As a result, by employing this embodiment, indicator assembly 53 is fully activated with alert indicator 54 being displayed prior to shackle 22 being released from housing 21.

The remaining components employed in constructing indicator assembly 53 of this embodiment of the present invention are substantially identical to the components detailed above in reference to the alternate preferred embodiment. As a result, without repeating the previous disclosure, this embodiment of padlock 20 also incorporates indicator lock assembly 70 which is automatically activated to securely maintain alert indicator 54 in the displayed position, once alert indicator 54 has been raised to its display position.

As detailed above, indicator lock assembly 70 comprises support base 71 and arm 72 which extends outwardly from base 71. In addition, arm 72 incorporates locking finger 73 mounted at the distal end, which is positioned for engaging with support shaft 56 in order to maintain alert indicator 54 in its raised position, until reset by the user. In this regard, each of these components, including their construction and operation, are substantially identical to the construction and operation detailed above.

In this regard, the reset operation for returning indicator 54 to its original position is also substantially identical to the operation detailed above, with the user employing a reset key for engaging base 71 of lock assembly 70 to release alert indicator 54 and enable alert indicator 54 to be returned to its original position. As is evident from this disclosure, the overall construction and operation of these components is equivalent to the construction and operation previously disclosed with the previous detailed discussion regarding these components being repeated and incorporated herein by reference.

Figure 14:
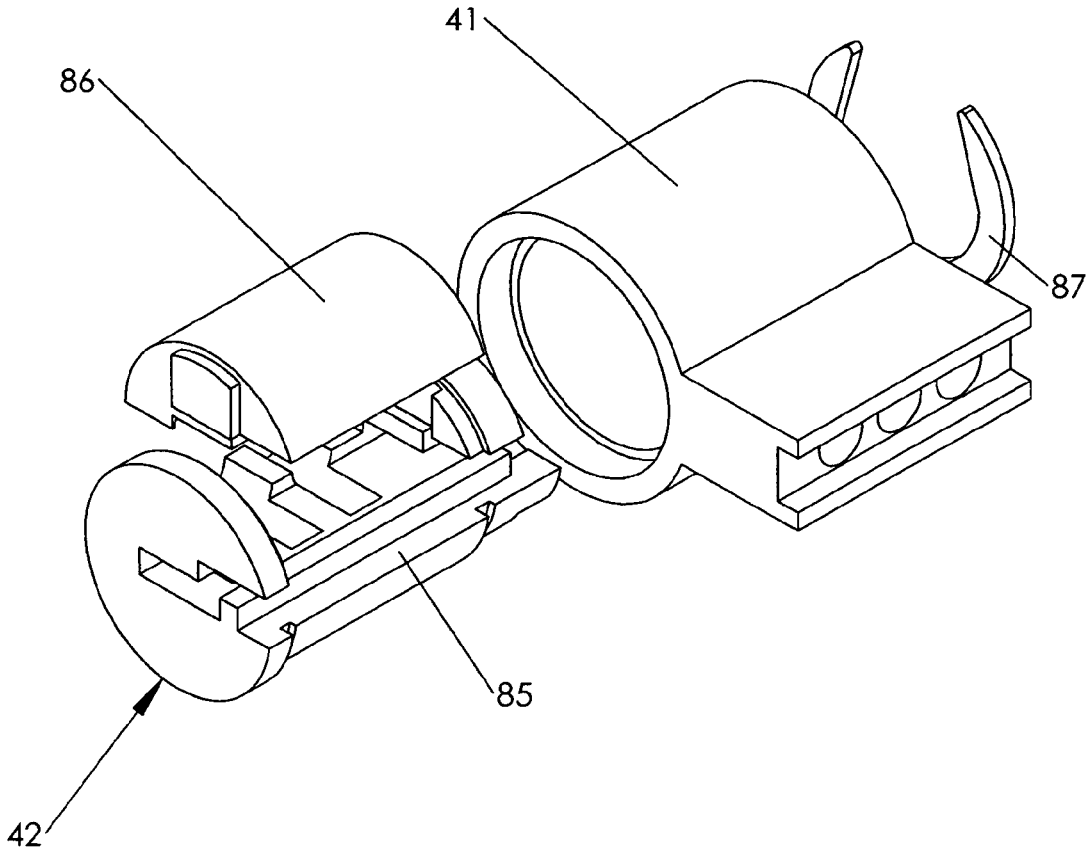
FIGS. 14 and 15 are perspective views of a cylinder housing in combination with a uniquely constructed two part cylinder plug'
Figure 15:
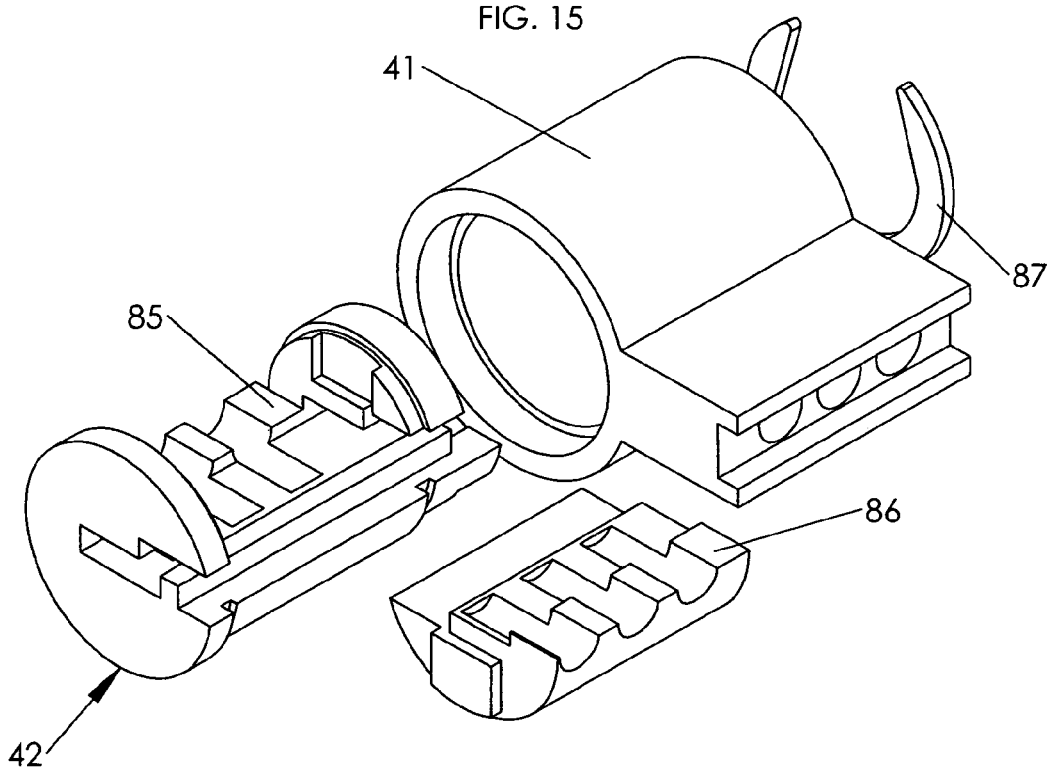
Figure 16:
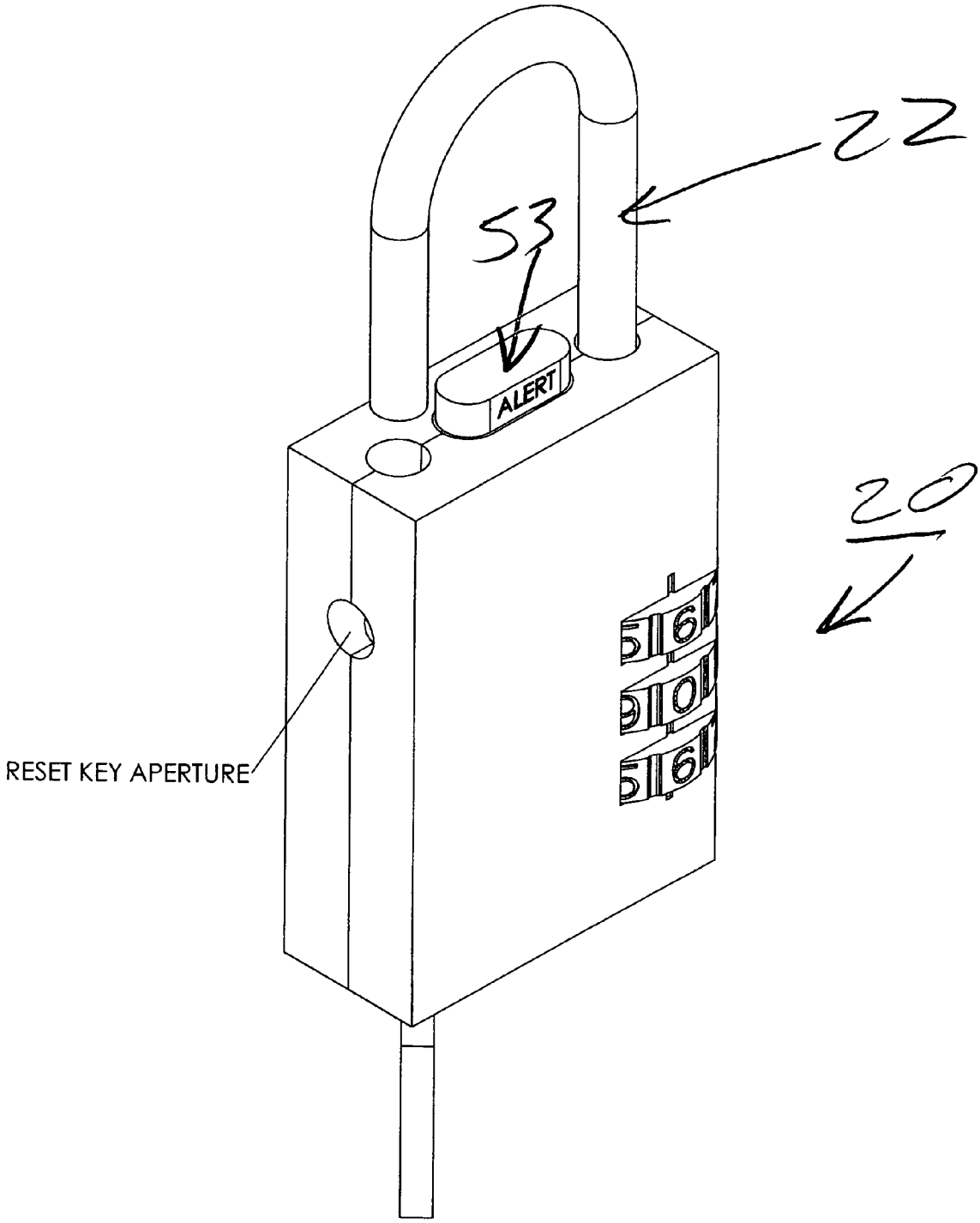
FIG. 16 is a perspective view of the padlock with a visual indicator of the present invention depicting the key controlled portion thereof associated with a combination controlled portion.
Figure 20:
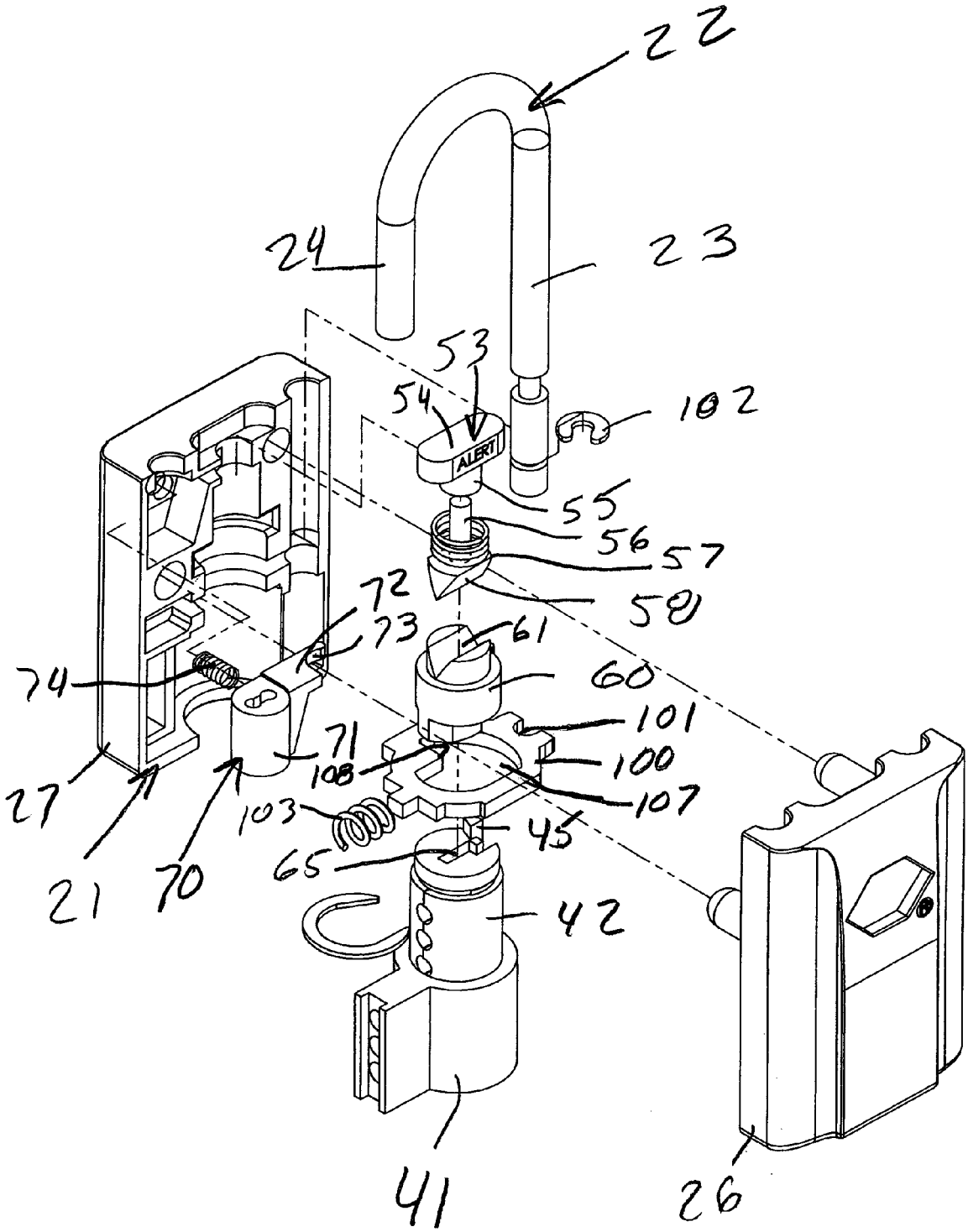
FIG. 20 is a front exploded perspective view of the key operated padlock with visual indicator embodiment of FIG. 17.
Figure 21:
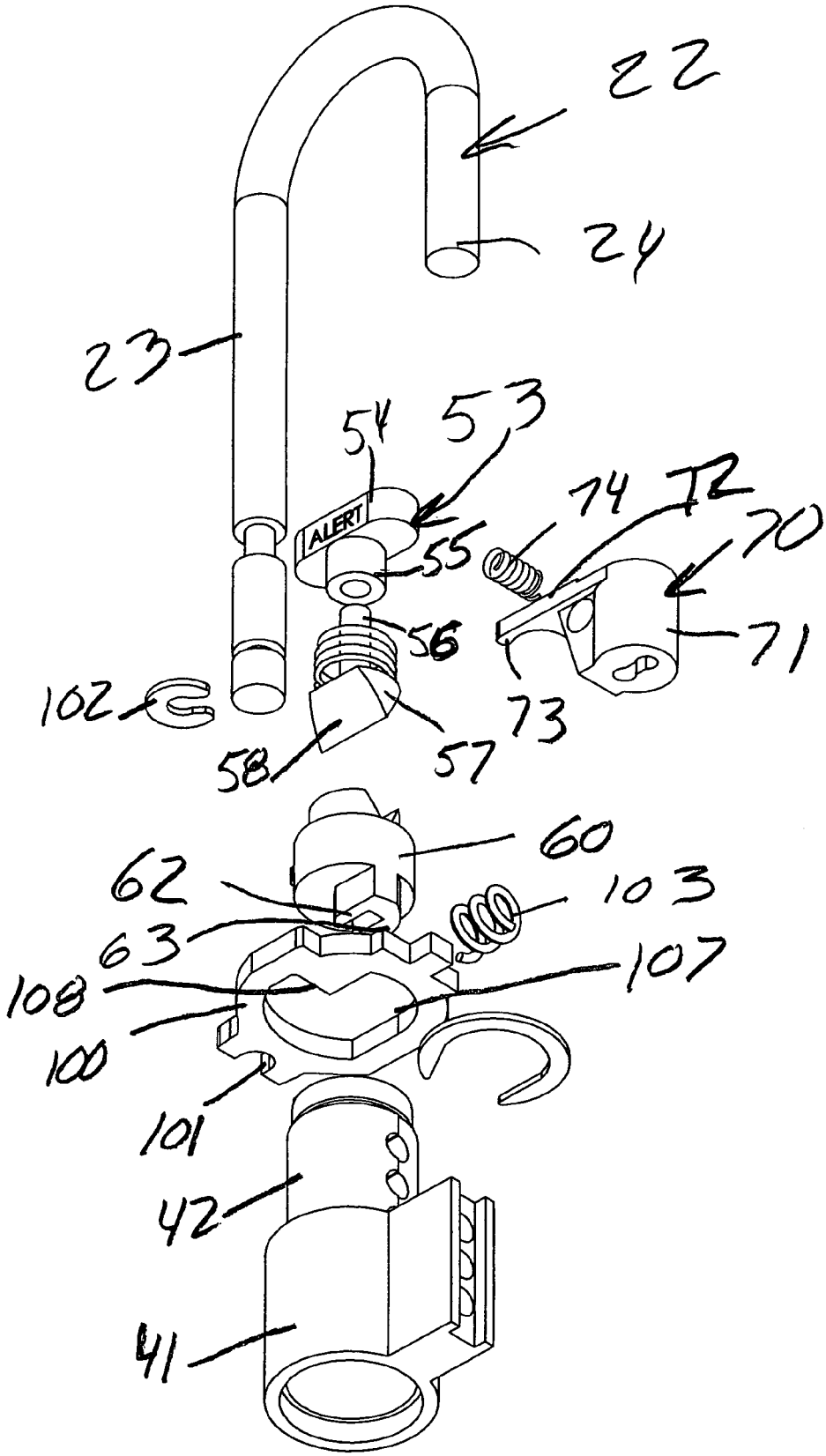
FIG. 21 is a rear exploded perspective view of the key operated padlock with visual indicator embodiment of FIG. 17 with the housing removed.

By referring to FIGS. 14 and 15, along with the following detailed discussion, a further feature in the construction of padlock 20 will be evident. In this regard, as discussed above, the manufacture of prior art cylinder plugs require expensive machining operations due to the need to have the cylinder plug cut from rod material, followed by numerous machining operations in order to produce the cavities within which the tumblers are mounted. However, by employing the present invention, all of these costly manufacturing steps are eliminated.

As depicted, in the preferred embodiment of the present invention, cylinder housing 41 is constructed in a manner substantially identical to the construction employed in the prior art. However, in constructing cylinder plug 42, a new, unique construction is employed which substantially reduces the manufacturing costs associated with the production of cylinder plugs. As shown, in accordance with the present invention, cylinder plug 42 is constructed from two mating components 85 and 86, which are constructed for nested, interengagement with each other to form cylinder plug 42.

By constructing cylinder plug 42 as two mating components 85 and 86, cylinder plug 42 is able to be manufactured by die casting machines. In this way, numerous components are produced simultaneously in a large-scale production operation.

Furthermore, by employing die casting for forming mating components 85 and 86, the interior cavities of cylinder plug 42 are formed simultaneously with the formation of components 85 and 86.

As a result, the various drilling, cutting, and machining steps required in prior art constructions to form the internal cavities in cylinder plug 42 are eliminated. In this way, cylinder plug 42 is produced efficiently at a substantially reduced cost. Furthermore, the secure mounting of cylinder plug 42 with cylinder housing 41 is achieved in the substantially identical manner found in the prior art, with the use of a circular clip or locking ring 87.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A padlock incorporating an indicator assembly which provides a positive, readily visible display whenever the padlock has been opened under specific circumstances, said padlock comprising A. a housing;

B. locking means in the form of a shackle cooperatively associated with the housing and movable between a first housing engaged position and a second housing released position;

C. a key controlled locking section a) mounted in the housing in controlling interengagement with the locking means for maintaining the locking means in its first housing engaged position and releasing the locking means for providing the second, housing released position, and b) comprising an arcuately pivotable cylinder assembly mounted in the housing and responsive to the insertion of a first user/owner key and a second master key for enabling the arcuate movement of the cylinder relative to the housing whenever the first key or the second key is inserted therein; and D. a signal/indicator system a) mounted in the housing in cooperating relationship with the key control locking section and responsive to the use of the master key for activation thereof, b) comprising an alert-providing indicator member movable between a first non-alert position and a second alert-providing position whenever the master key is employed for moving the locking means from its first housing engaged position into its second housing released position, thereby providing positive notice to the user that the master key has been employed, c) a support base on which the alert providing indicator member is supportingly retained with said support base comprising an arcuately curved or grooved lower surface, d) a control member having an arcuately curved or grooved top surface cooperatively associated with the lower surface of the support base for being normally in nested interengagement therewith prior to activation, and constructed for forcing the support base and associated alert-providing indicator member upwardly whenever the control member is arcuately pivoted due to the camming action of the engaged arcuately curved/grooved surfaces, e) a locking arm for maintaining the alert indicator member in its raised position until re-set by the user, and f) a movable arm supporting base mounted in the housing and constructed for being automatically moved with the locking arm when the indicator member is activated and being returned to its original position by the user thereby disengaging the locking arm from the indicator member.

2. The padlock defined in claim 1, wherein both the master key and the user key are constructed for enabling the cylinder to rotate, with the master key being further defined as comprising an overall working length greater than the length of the user key.

3. The padlock defined in claim 2, wherein the cylinder assembly is further defined as comprising a cylinder housing constructed for secure mounted interengagement in the housing of the padlock and a cylinder member a) pivotally mounted in the cylinder housing for arcuate rotation relative thereto in response to the insertion of a mating user key and/or master key, b) incorporating a key receiving slot formed therein and extending longitudinally through the cylinder member, and c) comprising an upstanding boss formed on the distal end of the cylinder member, said boss being positioned for controlling engagement with a release assembly controllably associated with the locking means.

4. The padlock defined in claim 3, wherein the locking means is further defined as comprising a j-shaped shackle incorporating a short leg having a terminating end constructed for cooperative locking and unlocking inter-engagement with a portal formed in the housing and a long leg mounted in the housing for axial movement and pivoting movement therein.

5. The padlock on defined in claim 4, and further comprising a release assembly mounted in the housing in cooperating, controlling engagement with the long leg of the shackle for normally maintaining the short leg of the shackle in locked engagement with the cooperating portal of the housing and being cooperatively associated with the upstanding boss formed on the cylinder member of the cylinder assembly for causing the release assembly to be dislodged from holding engagement with the long leg of the shackle, thereby enabling the short leg of the shackle to be disengaged from lock engagement with the portal of the housing.

6. The padlock defined in claim 5, wherein the release assembly is further defined as comprising a spring biased arm member mounted in the housing and constructed for cooperating interengagement with a notched zone formed along the long leg of the shackle for maintaining the shackle in its locked position, while also being arcuately movable in response to contact therewith by the upstanding boss of the cylinder member for removing the arm member from engagement in the notched zone, thereby enabling the shackle to move into its unlocked, housing disengaged position.

7. The padlock defined in claim 5, wherein the release assembly is further defined as comprising a spring biased, longitudinally movable plate mounted in the housing and constructed for cooperating engagement with a notched zone formed along the long leg of the shackle for maintaining the shackle in its normally locked position, while also being a longitudinally movable in response to contact therewith by the upstanding boss of the cylinder member, for removing the plate from engagement in the notched zone, thereby enabling the shackle to move into its unlocked, housing disengaged position.

8. The padlock defined in claim 7, wherein the movable plate is further defined as comprising an arcuately curved open zone formed therein, positioned in peripherally surrounding relationship with the cylinder member of the cylinder assembly, and incorporating an abutment wall formed therein, said abutment wall being positioned for engagement by the upstanding boss of the cylinder member for causing the movable plate to longitudinally move relative to the housing.

9. The padlock defined in claim 8, wherein said abutment wall is further defined as being spaced away from the initial position of the upstanding boss by an arcuate distance of about 90°, thereby requiring the upstanding boss to travel through a 90° arcuate path before contacting the abutment wall.

10. The padlock defined in claim 1, wherein the control member is further defined as comprising spaced panel members formed on the base thereof and positioned in overlying, straddling engagement with the slot of the cylinder member for enabling the distal end of the longer lengthened master key to extend outwardly from the slot of the cylinder member into a position between the spaced panel members for enabling the arcuate movement of the master key with the cylinder member to simultaneously cause the control member to pivot therewith, said pivoting movement causing the arcuately curved or grooved top surface thereof to force the arcuately/grooved lower surface of the support base to move vertically upwardly, causing the alert providing indicator member attached thereto to be moved into its display position.

11. The padlock defined in claim 1, wherein the arm supporting base is positioned in association with the portal in which the short leg of the shackle cooperates for enabling the user to access the arm supporting base and move the arm supporting base for disengaging the locking arm from the indicator member.

12. The padlock defined in claim 11, wherein a re-set element is employed by the user to engage the arm supporting base and cause the arm supporting base to move from its arm locking position into its arm disengaged position.

13. The padlock defined in claim 12, wherein the reset element is further defined as being formed of one selected from the group consisting of a separate key and the user key.

14. The padlock defined in claim 3 and further comprising:

E. a combination controlled locking section mounted in the housing and cooperatively associated with the shackle forming locking means for enabling the shackle to be moved between its first housing engaged position and its second housing released position independently of the key controlled locking section.

15. The padlock defined in claim 14, wherein the shackle is further defined as comprising a J-shape and the combination controlled locking section is further defined as comprising a plurality of rotatable dials mounted to the longer leg of the J-shaped shackle in cooperating association therewith to enable the axial movement of said shackle when each of the dials is placed in a pre-determined position and preventing the axial movement of the shackle whenever all of the dials are not placed in their pre-determined position.

16. The padlock defined in claim 3, wherein the arcuately pivotable cylinder member is further defined as comprising two mating components constructed for nested engagement with each other to form the fully constructed cylinder member.

17. The padlock defined in claim 16, wherein each component of the cylinder member comprises substantially one-half of a longitudinally extending segment of the cylinder member.

18. The padlock defined in claim 17, wherein each component is further defined as being formed by die casting, with all cavities thereof being integrally formed during the casting operation.

* * * * *